US005399957A

United States Patent [19]

Vierboom

[11] Patent Number: 5,399,957

[45] Date of Patent: Mar. 21, 1995

[54] DC SWITCHED ARC TORCH POWER SUPPLY

[75] Inventor: Peter Vierboom, Sydney, Australia

[73] Assignee: The University of Sydney The Electricity Commission of New South Wales, New South Wales, Australia

[21] Appl. No.: 946,428

[22] PCT Filed: Nov. 28, 1991

[86] PCT No.: PCT/AU91/00203

§ 371 Date: Jan. 4, 1993

§ 102(e) Date: Jan. 4, 1993

[87] PCT Pub. No.: WO91/18488

PCT Pub. Date: Nov. 28, 1991

[30] Foreign Application Priority Data

May 15, 1990 [AU] Australia ..... PK 0141

[51] Int. Cl.[6] ..... G05F 1/40; H05B 7/18

[52] U.S. Cl. ..... 323/282; 323/351; 219/383

[58] Field of Search ..... 323/222, 282, 284, 351; 219/383, 384

[56] References Cited

U.S. PATENT DOCUMENTS

| | | | |
|---|---|---|---|
| 3,577,030 | 5/1971 | Cusick et al. . | |
| 3,835,368 | 9/1974 | Williams | 323/351 |
| 3,868,561 | 2/1975 | Matthes . | |
| 4,009,365 | 2/1977 | Kalev . | |
| 4,225,769 | 9/1980 | Wilkins . | |
| 4,249,061 | 2/1981 | Puschner . | |
| 4,322,709 | 3/1982 | Vonder et al. . | |
| 4,324,971 | 4/1982 | Frappier . | |
| 4,910,635 | 3/1990 | Gilliland . | |
| 4,943,699 | 7/1990 | Thommes . | |
| 5,086,205 | 2/1992 | Thommes . | |
| 5,166,871 | 11/1992 | Carroll et al. | 323/284 X |

FOREIGN PATENT DOCUMENTS

| | | |
|---|---|---|
| 1272178 | 4/1972 | United Kingdom . |
| 1329438 | 9/1973 | United Kingdom . |
| 1437107 | 5/1976 | United Kingdom . |
| 1468198 | 3/1977 | United Kingdom . |
| 2019135 | 10/1979 | United Kingdom . |

OTHER PUBLICATIONS

Supplementary European Searle Report (2 pages) Apr. 26, 1993.

Database WPIL, Week 338, Derwent Publications Ltd. London, GB; AN 88-233345 [33] & SU-A-1 368 128 (Gorki Poly) 23 Jan. 1988 (abstract).

Patent Abstracts of Japan, vol. 7, No. 178 (E-191) 6 Aug. 1983 & JP-A-58 084 415 (Tetsushin Kogyo) 20 May 1983 (abstract).

*Primary Examiner*—Steven L. Stephan
*Assistant Examiner*—Ed To
*Attorney, Agent, or Firm*—Townsend & Townsend Khourie & Crew

[57] ABSTRACT

A dc power supply (1) for a dc arc torch (6) comprising: an input port (4, 8) for connection to a source of direct current and an output port for connection to the electrodes (5, 7) of an arc torch; a controlled switch (2) and an inductance (3) connected in series between the input port and the output port; a free-wheeling diode (9) connected such that, in use, it is reverse biased when the switch (2) is ON, and forward biased when the switch (2) is OFF to maintain direct current flow through the arc and the inductance (3); and a feedback circuit (10) having a current sensor (11) to sense the instantaneous value of current flowing through the arc, and a control terminal (26) connected to the switch (2), the feedback circuit, in use, operating to provide a control signal at the control terminal (26) to turn the switch (2) ON when the instantaneous value reaches a first level and OFF when the instantaneous value reaches a second level.

6 Claims, 3 Drawing Sheets

DC SWITCHED ARC TORCH POWER SUPPLY

TECHNICAL FIELD

This invention concerns a direct current (dc) arc torch power supply. Direct current arc torches employ an electrical discharge arc to heat a working gas and generate a plasma which is then passed through a nozzle comprising the hollow anode of the torch. The plasma may be used to ignite combustible fuel, such as pulverized coal, in a steam raising boiler to generate electrical power. The plasma may also be used to warm the combustion chamber prior to ignition, and to ensure stable combustion of the fuel.

Such an arc torch may require a voltage in the range of 0 to 1,000 volts and a current range of from 100 to 300 Amps, that is electrical power in the range from 0 kW to 300 kW.

The arc torch, in this application, is required to generate plasma over long periods of time. It has, however, proved difficult to maintain the arc reliably over such periods of time using conventional power supplies.

One of the particular problems that arises in generating an electrical discharge arc in a dc arc torch, is that the arc has a large voltage drop from anode to cathode with high levels of voltage fluctuations. The arc will also, normally, have an inverse voltage-current relation so that current rises the voltage drop across the arc will fall. As a result, it is necessary for the power supply to react to a fall in voltage by limiting the arc current.

BACKGROUND ART

A known power supply employs a thyristor, or a silicon controlled rectifier (SCR), in each phase of an alternating current main supply. At least two of the thyristors are always ON at any given time to conduct current to an inductor which stores energy and smooths the output. The other thyristors are sequentially turned ON, to control the average current flow, by means of a predictive control circuit, which attempts to predict the current demand over the following cycle. The thyristors are turned OFF by the next current zero to arrive.

This supply has a number of disadvantages. The first is that control is only exercised over the current at the times when the thyristors are being turned ON. This implies an average delay in the current control of a third of a period of the supply (when a thyristor is used in each phase of a three phase supply). It follows that there is a maximum rate at which current can be controlled. As a result, the inductance must be large enough to limit current ripple at higher rates. This is essential because current zeros extinguish the arc and high current peaks lead to electrode degradation. For example, a 50 kW arc torch consuming 200 Amps will need an inductor of 20 mH, which would weigh several tons, to limit current ripple to less than 50 Amps. This adds greatly to the expense of the power supply.

A second disadvantage arises from the fact that the switching control is predictive and results from a calculated guess rather than being absolutely determined from the current actually flowing at any given time.

SUMMARY OF THE INVENTION

According to the present invention, there is provided a dc power supply for a dc arc torch comprising an input port for connection to a source of direct current and an output port for connection to the electrodes of an arc torch.

A controlled switch and an inductor are connected in series between the input port and the output port.

A free-wheeling diode is connected such that, in use, it is reverse biased when the switch is ON, and forward biased when the switch is OFF to maintain direct current flow through the arc and the inductance.

A feedback circuit has a current sensor to sense the instantaneous value of current flowing through the arc, and a control terminal connected to the switch. The feedback circuit, in use, provides a control signal at the control terminal to turn the switch ON when the instantaneous value reaches a first level and OFF when the instantaneous value reaches a second level to maintain the instantaneous value substantially between the first and second levels.

This circuit uses a direct current input and controls it to provide the required current to the arc. It has the advantage that the current produced is independent of the arc voltage waveform, and it is determined by a feedback circuit operating in real time, rather than a predictive controller; this makes the control more accurate and sensitive.

The feedback circuit is arranged to turn the switch OFF when the instantaneous arc current measured by the current sensor reaches a selected maximum, and to turn the switch ON when the instantaneous arc current reaches a selected minimum. In other words, the arc current is controlled not to exceed a certain preselected degree of ripple.

One advantage of controlling the current ripple flows from the fact that the cathode erosion rate is proportional to the instantaneous current; a current lump of even microsecond duration can cause microboiling. A reduction in the maximum current results in greatly increased cathode lifespan.

The selection of a lower degree of current ripple causes the switch to operate at higher frequencies. A reduction in the size of inductance can also be achieved if higher operating frequencies are used. For instance, an arc consuming 200 Amps would only require a 2 mH inductor to limit current ripple to 50 Amps when a power supply embodying the invention is employed. This is a ten to one reduction in size compared with known power supplies.

Preferably, the feedback circuit includes means to ensure that the switch is not OFF for less than a minimum time, nor ON for less than a minimum time, and means to ensure the current does not exceed a fault level. This is to protect the switch against failure of either the inductor or the free-wheeling diode. In a preferred embodiment of the invention, all these means are provided by gates which gate the feedback signal with signals representing the required quantities.

It should be appreciated that there is no clock signal and the switching frequency is determined by the degree of current ripple selected, the inductance and the difference between the supply voltage and the arc voltage drop.

The current sensor is preferably a Hall-effect device which has the advantage over an inductive sensor that it produces a signal carrying both ac and dc information about the current.

The inductance is preferably an air-gap choke; in which the air-gap linearizes the inductance of the choke.

BRIEF DESCRIPTION OF THE DRAWINGS

The invention will now be described by way of example only, with reference to the accompanying drawings, in which.

DESCRIPTION OF THE PREFERRED EMBODIMENT

Figure 1:
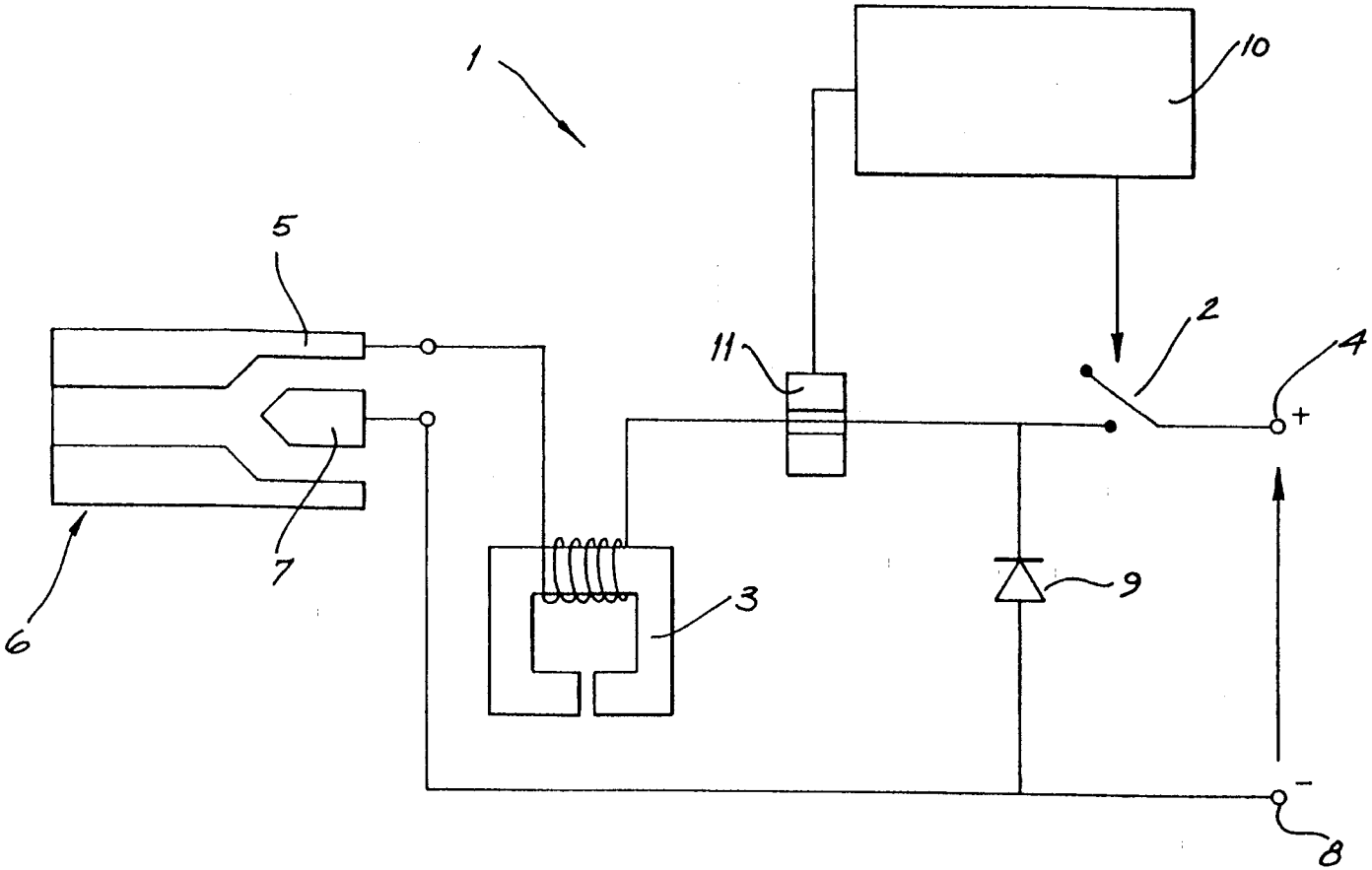
FIG. 1 is a schematic circuit diagram of power supply for an arc torch embodying the present invention.

Referring now to FIG. 1, power supply 1 comprises a gate turn-off thyristor (GTO) switch 2 and an air-gap choke (inductor) 3 connected in series between an input port and an output port, in particular between the positive terminal 4 of a direct Current supply, and the anode 5 of an arc torch 6. Cathode 7 of arc torch 6 is connected to the negative terminal 8 of the dc supply. A free-wheeling diode 9 is connected from between switch 2 and inductance 3 back to the negative terminal 8 of the supply. A feedback circuit 10, including a Hall-effect current sensing device 11 associated with the current path flowing through inductance 3 and arc torch 6, turns the switch ON and OFF.

The dc supply will typically be derived from a three-phase alternating main supply by conventional rectification and smoothing.

The effect of switch 2 being turned ON and OFF is to step down the average value of the dc supply. When switch 2 is ON, current (ramping up) flows from the supply through the inductance 3 and arc torch 6. When switch 2 is OFF, current (ramping down) continues to flow through inductance 3 and arc torch 6, but is drawn through free-wheeling diode 9. In effect energy stored by inductance 3 when switch 2 is ON is used to maintain current flow through the arc when switch 2 is OFF. The energy stored in the inductance is gradually dissipated by total resistance made up of the arc, the resistance of the inductance and the forward resistance of the free-wheel diode; with the arc resistance dominating.

Figure 2:
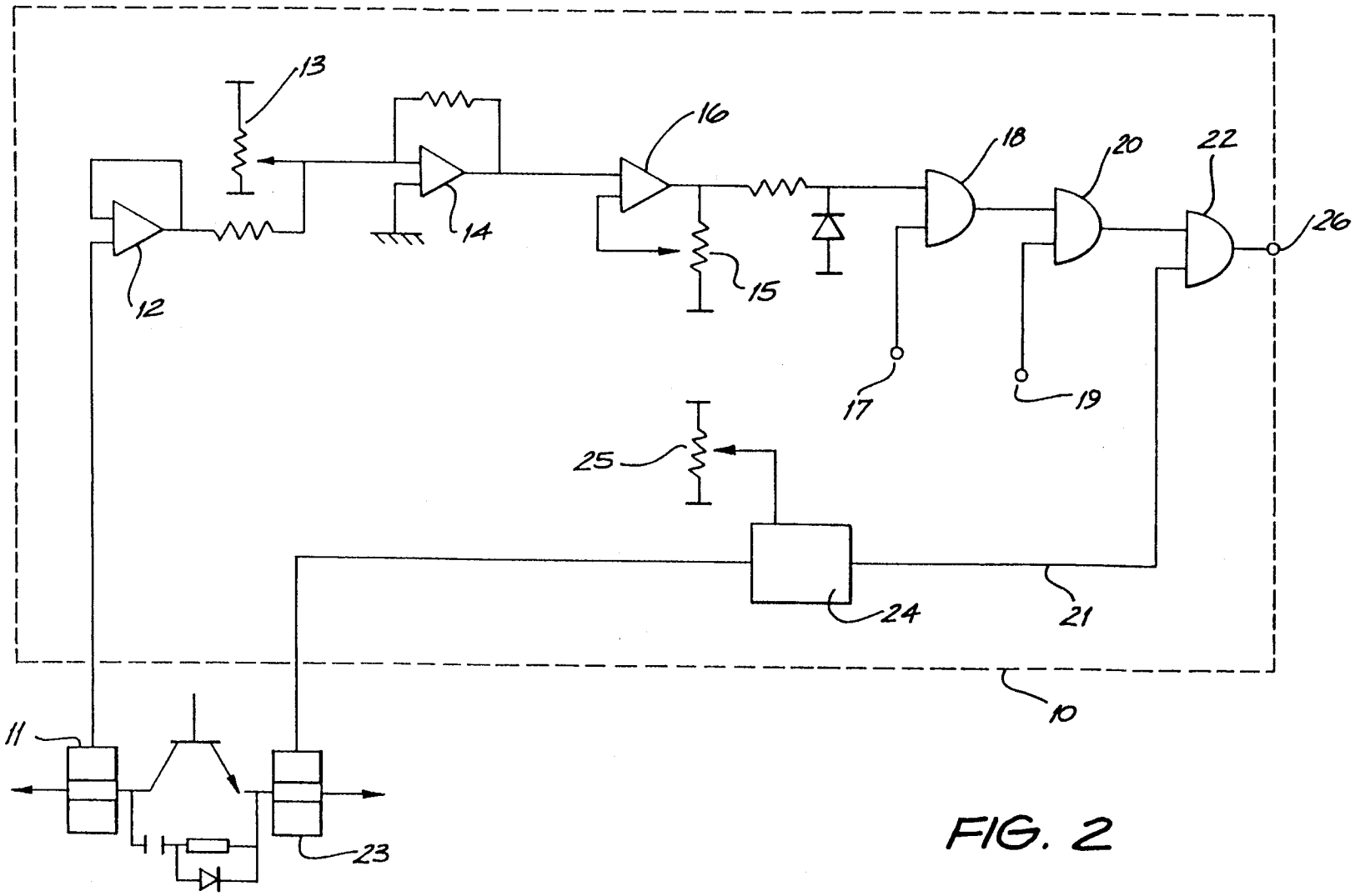
FIG. 2 is a schematic circuit diagram of a feedback circuit in accordance with an embodiment of the present invention; and FIGS. *3a–3c* are graphs showing the current variation with voltage of a power supply embodying the invention and showing a comparison with a prior art supply.
Figure 3A:
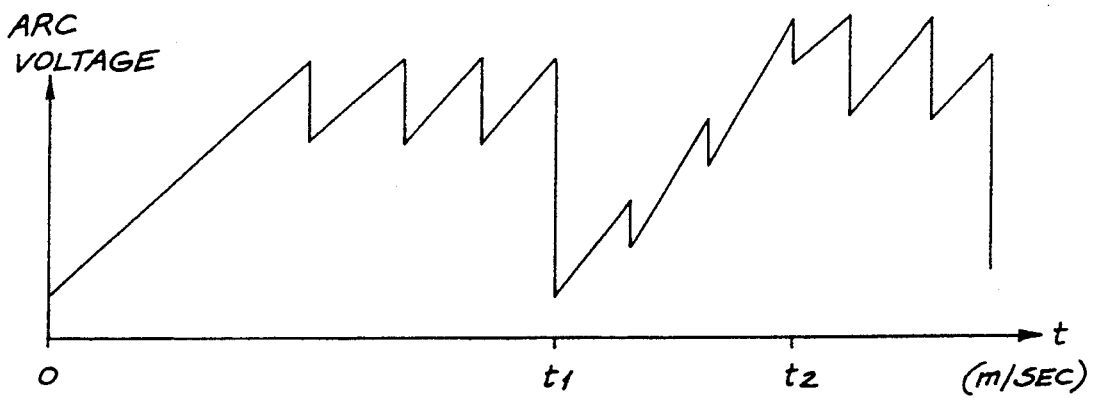
Figure 3B:
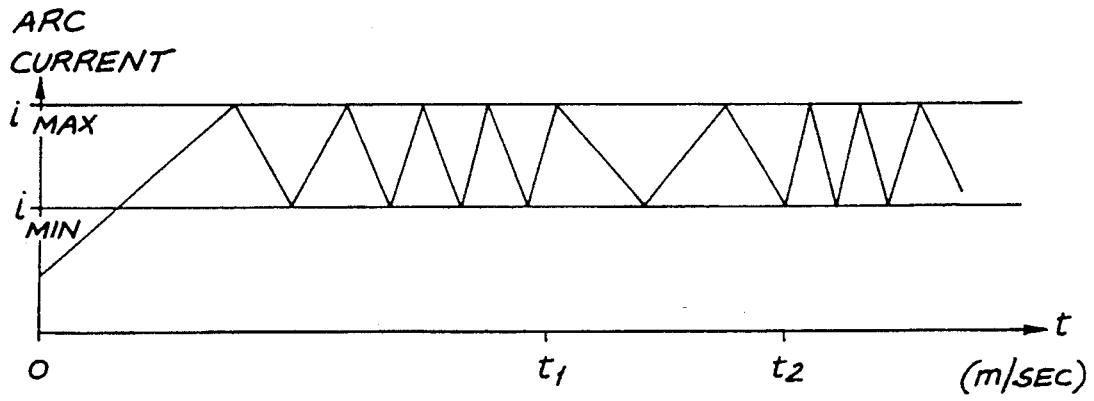
Figure 3C:
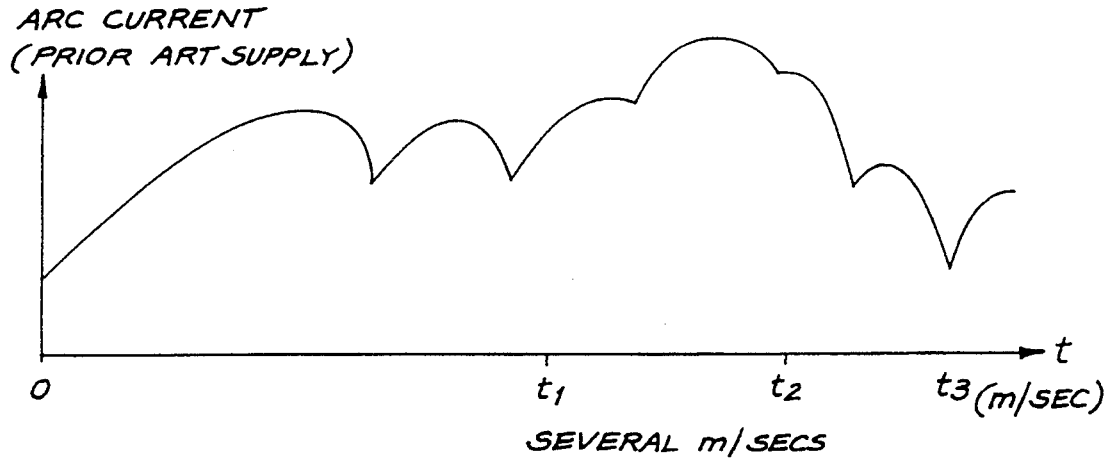

Referring now to FIG. 2, the feedback circuit is described in greater detail. The signal from sensor 11 is isolated by Op-Amp 12 and subtracted from the preset voltage on potentiometer 13 by Op-Amp 14. The preset voltage represents the desired arc current level (for instance 160 Amps). The difference is amplified and compared with an hysteresis value, which is adjusted by potentiometer 15. The hysteresis value represents the selected maximum allowable ripple (for instance 12 Amps). When the hysteresis value is exceeded the output of Op-Amp 16 changes state; its output is a rectangular wave. This signal is then gated with a signal 17 representing the minimum OFF-time, in gate 18; then gated with a signal 19 representing the minimum ON-time, in gate 20; and finally gated with a signal from line 21 indicative of a current fault condition, in gate 22.

The current fault condition is derived from a second current sensor 23. The signal this provides is processed in processor 24 and compared with a level set on potentiometer 25 to provide a signal when the current flowing through the switch inductance and arc exceeds a value determined by potentiometer 25; this provides overcurrent protection to the switch.

The signal arriving at output terminal 26 is, therefore, not only controlled to drive switch 2 ON and OFF according to the current measured by sensor 11, but also to ensure it remains within the desired minimum ON-time and minimum OFF-time and to react to an overcurrent fault condition. The signal at terminal 26 may be input to the base of a power transistor either directly or via a transistor driving circuit. It should be appreciated that a monostable or clock signal generator is not required.

The variation of arc current with arc voltage will now be described with reference to FIGS. *3a–3c*.

FIG. *3a* shows the typical variation of arc voltage with time. The power consumed by the arc depends on demand and this determines the voltage. When the arc is struck the voltage builds to the maximum demand level as the root of the arc extends along the anode away from the cathode. The arc then periodically restrikes closer to the cathode and rebuilds again, causing an instantaneous fall in voltage followed by a gradual build up. At time $t_1$ the arc restrikes much nearer the cathode than usual, causing a much greater than normal voltage drop. The arc then rebuilds to normal at time $t_2$ during several gradually extending restrikes. Over the same period of time the voltage returns to its normal operating range.

FIG. *3b* shows the variation of arc current over the same period of time. When the arc is initially struck the arc current rises to its maximum value, $i_{max}$. Then it falls to its minimum value $i_{min}$ and rises up to its maximum value repeatedly. Variations in voltage level do not cause corresponding changes in current level, but cause changes in the switching frequency of the current; falls in voltage cause a reduction in switching frequency, but no change in average current.

FIG. *3c* shows the behavior of a prior art predictive power supply. The fall of voltage at $t_1$ causes an increase in current, as the predictive controller compensates. As the voltage recovers the predictive controller reduces current; this type of current reduction can extinguish the arc.

Although the invention has been described with reference to particular embodiments, it should be appreciated that it could be embodied in many other ways. For instance, suitable snubber protection may be included around the switching device.

I claim:

1. a dc power supply, for use with a source of direct current, for supplying direct current to electrodes of a dc arc torch comprising:

a power supply circuit including an input port coupled to the source of direct current and an output port coupled to the electrodes of the arc torch;

a control switch and an inductor connected in series along the power supply circuit between the input port and the output port;

a free-wheeling diode coupled to the power supply circuit such that the diode is reverse biased when the switch is ON, and forward biased when the switch is OFF so to maintain direct current flow across the electrodes and through the inductor; and a feedback circuit having a current sensor to sense an instantaneous value of current flowing across the electrodes and a control terminal connected to the switch, the feedback circuit providing a control signal at the control terminal to turn the switch ON when the instantaneous value reaches a first level and OFF when the instantaneous value reaches a second level to maintain the instantaneous value substantially between the first and second levels, the first level being less than the second level.

2. A dc power supply according to claim 1, wherein the feedback circuit further comprises means to generate a first signal related to the difference between the instantaneous value of the direct current and a preset value.

3. A dc power supply according to claim 2, wherein the feedback circuit further comprises means to compare the first signal with a hysteresis signal related to the difference between the first and second levels and to produce a two-state control signal, the comparing means changing a state of the two-state control signal when the first signal is greater than the hysteresis signal.

4. A dc power supply according to claim 3, wherein the feedback circuit further comprises an OFF gate adapted to gate the two-state control signal with an OFF signal representing a minimum OFF time so that the switch is not OFF for less than the minimum OFF time.

5. A dc power supply according to claim 3, wherein the feedback circuit further comprises an ON gate adapted to gate the two-state control signal with an ON signal representing a minimum ON time so that the switch is not ON for less than the minimum ON time.

6. A dc power supply according to claim 3, wherein the feedback circuit further comprises a FAULT gate adapted to gate the two-state control signal with a FAULT signal indicating a .current fault condition so that the direct current flowing through the arc remains below a predetermined maximum value.

* * * * *